United States Patent [19]

Bouchara et al.

[11] 4,379,276

[45] Apr. 5, 1983

[54] PROCESS AND APPARATUS FOR THE MULTIPOLAR MAGNETIZATION OF A MATERIAL IN STRIPS

[75] Inventors: Claude Bouchara, Bernin; Robert Henaff, Saint-Martin-d'Heres; Pierre Jacob, Eybens, all of France

[73] Assignee: Aimants Ugimag S.A., Saint-Pierre-d'Allevard, France

[21] Appl. No.: 229,742

[22] Filed: Jan. 29, 1981

[30] Foreign Application Priority Data

Feb. 15, 1980 [FR] France ..... 80 03758

[51] Int. Cl.[3] ..... H01F 7/20

[52] U.S. Cl. ..... 335/284; 335/306

[58] Field of Search ..... 335/284, 306, 302, 303

[56] References Cited

U.S. PATENT DOCUMENTS

| | | | |
|---|---|---|---|
| 2,501,615 | 3/1950 | Pugh | 335/284 |
| 3,127,544 | 3/1964 | Blume | 335/284 |
| 3,206,655 | 9/1965 | Reijnst | 335/306 |
| 4,292,261 | 9/1981 | Kotani et al. | 335/306 |

*Primary Examiner*—Harold Broome

*Attorney, Agent, or Firm*—Dennison, Meserole, Pollack & Scheiner

[57] ABSTRACT

A process and apparatus for permitting the magnetization of materials in the form of sheets or strips, such as magnetic rubber, wherein one or two stacks formed by flat main magnets 1 adjacent to ferromagnetic pole pieces 2 in the vicinity of which (or between which) travels the strip to be magnetized. The main magnets adjacent to the same pole piece having opposing magnetizations as well as the magnets located face to face in each of the stacks. The device can be completed by field magnets δ and intermediate magnets 9.

13 Claims, 10 Drawing Figures

FIG.1
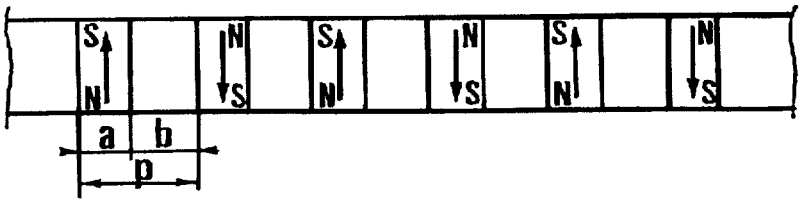
FIG.2
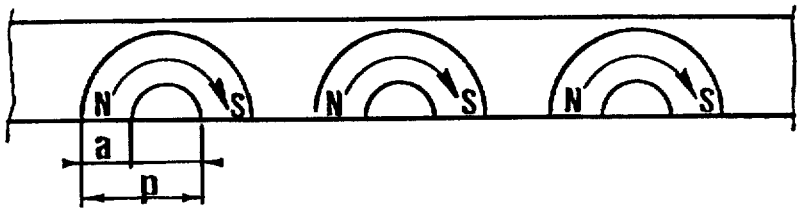
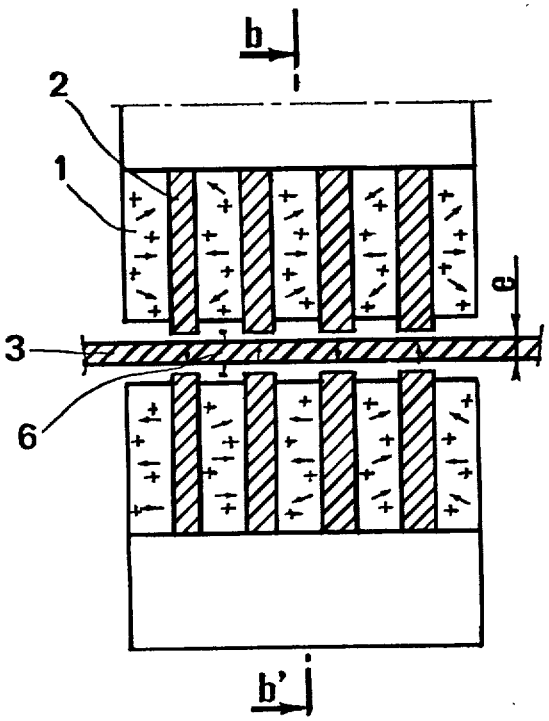
FIG.3
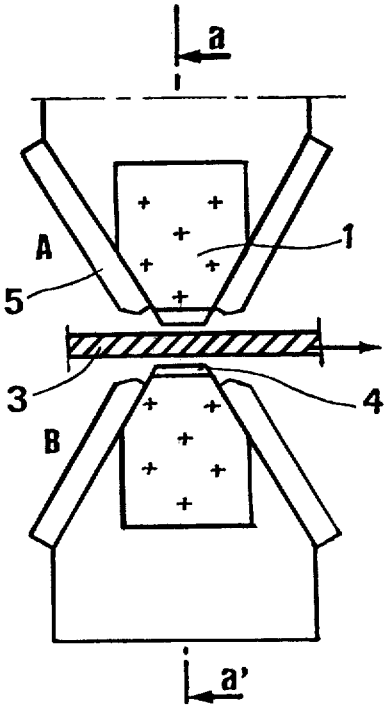
FIG.4

PROCESS AND APPARATUS FOR THE MULTIPOLAR MAGNETIZATION OF A MATERIAL IN STRIPS

The present invention relates to a device for effecting the multipolar magnetization of a magnetizable material in the form of sheets or strips, more particularly of relatively thin flexible strips of the magnetic rubber type.

It is known to imprint magnetic poles of alternating polarity on the surface of a strip to be magnetized by causing the strip of material to be magnetized to travel in the immediate vicinity of the active portion of a magnetizing apparatus or in the air gap of such an apparatus producing an adequate magnetic field. The multipolar magnetization obtained can be of the traversing type, which means that the two faces of the strip or of the sheet exert a magnetic attraction of approximately the same value. On the other hand, it can be of a non-traversing type and, in this case, only one of the faces of the sheet or strip exerts the main magnetic pull while the other face is reserved for other uses and is able to receive, for example, some decoration, paint or an adhesive, or alternatively a sheet of mild magnetic material.

In order to magnetize a material, it is necessary to apply an adequate magnetic field to it, the intensity of which depends on the intrinsic coercive field of the material and the direction of which depends on the field lines to be imprinted in this material.

In the known processes of magnetization (see, for example, "Permanent Magnets and Magnetism" edited by D. Hadfield, Iliffe books 1962, London, Chapter 9), this magnetic field can be generated in two ways:

(1) Either the field is produced by direct, optionally impulsive electric currents by using, for example, electromagnets, coils (solenoids) or the discharge of capacitors. Devices of this type which are specific to the magnetization of sheets or strips are described in French Pat. Nos. 1,471,725, 2,106,213, or 2,211,731, or U.S. Pat. No. 3,127,544.

However, these systems are essentially intended for single face magnetization (except in U.S. Pat. No. 3,127,544). Nevertheless, they are expensive as they are complex, often fragile, subject to heating up and are high energy consumers and can be dangerous. They are limited in the number of poles and in possible active surfaces due to problems of insulation of the conductors and the electro-magnetic stresses applied to them. Moreover, the production rates are frequently limited to a strip speed of less than 1 m/min, and even much less in the case of double face multipolar magnetization.

(2) Or the magnetic field is produced by permanent magnets, in which case, the following benefits are obtained:

very low energy consumption limited to the mechanical energy needed for extracting the magnetic form from the apparatus, high reliability in operation, high safety in use (absence of high voltage), the elimination of internal stresses in the apparatus.

However, the main disadvantages of systems with Alnico or ferrite type permanent magnets are:

the production of a relatively weak magnetic field, therefore, the difficulty of effecting magnetization of strongly coercive materials, the difficulty in obtaining the multipolar magnetization of magnetic materials in sheet form as described above.

The present invention relates to a device for the magnetization of materials in sheets or strips which overcomes all the above-mentioned disadvantages, in which the magnetic field is created by permanent magnets capable of magnetizing strongly coercive materials to technical saturation, of effecting multi-polar magnetization of a very variable form, and of permitting a very high speed of travel of the strip of, for example, several tens of meters per minute.

The device for the multi-polar magnetization of a material in strip form on one face or on two faces, forming the subject of the present invention, involves producing one or two stacks on their large parallel faces of flat prismatic elements, these elements being permanent magnets with a high coercive field, known herein as "main magnets" and pole pieces made of magnetically mild material alternately, the direction of magnetization of the main magnets having a component perpendicular to the large faces of the elements and in opposite directions in the case of the two main magnets adjacent to the same pole piece.

In order to magnetize a strip, the strip is made to travel in the immediate vicinity or against a stack or, preferably, in a direction approximately parallel to the large faces of the flat elements and the plane of the strip generally being in a plane perpendicular to the large faces of the elements.

As main magnets, it is preferable to select magnets made of rare earth-cobalt alloys, such as sumarium-cobalt $Sm\ Co_5$. The magnetically mild material used for the pole pieces is preferably soft iron or an iron-cobalt alloy, but it is also possible to use permalloy, iron-nickel alloys, silicon, or carbon steel, or soft ferrites, depending on the magnetic permeability required.

In order to obtain traversing magnetization, the strip is made to travel in the air gap defined by two stacks placed face to face. On the other hand, to obtain non-traversing magnetization, it is sufficient to use a single stack or to replace the second stack by a block of soft iron (or other ferromagnetic material) or any other non-magnetic device permitting, for example, the displacement and the guidance of the strip or of the sheet.

The flat elements are defined by two large parallel faces and the stack is made on these large faces. When the strip travels in the air gap or in the vicinity of the active portion of the magnetizing medium, it is generally located in a plane perpendicular to these large faces and it advances in a direction defined herein as the axis of travel which is approximately parallel to the plane of the large faces. If the strip has a certain curvature in the longitudinal direction in the immediate vicinity of the magnetizing medium or in the air gap, the term "plane of the strip" and "axis of travel" refer to the plane tangential to this strip along the generatrix of the strip closest to the magnetizing medium and the tangent to the curve of advance of a point on the strip located in the preceding tangential plane respectively.

The direction of magnetization of the main magnet is non-parallel to the large faces of these magnets and of the adjacent pole pieces. In the case of two main magnets situated on either side of the same pole piece, the directions of magnetization N-S are opposed. As the pole pieces serve to channel the magnetic flux produced by the opposing magnets towards the air gap or the surface of the magnetizing medium, there is an alternation in the north and south poles separated by neutral zones situated over the same width of the strip at the point where the pole pieces emerge at the surface of the magnetizing medium.

If traversing magnetization is to be achieved, the two stacks are placed face to face so that the similar elements of each stack face each other and the directions of magnetization N-S of two facing main magnets are opposed to each other.

In a first variation of the apparatus of the invention, the flat stacked elements have a lateral surface which contracts in the vicinity of the strip, for example, a trapezoidal cross-section of which the small base is situated next to the strip so as to orientate and concentrate the magnetic flux towards the strip. These cross-sections do not necessarily define a single prismatic lateral surface of the stack.

In a second variation, stacked pole pieces have the shape of circular discs exhibiting a cylindrical external surface of revolution which are movable about a non-ferromagnetic axis, and this prevents the strip from sliding relative to the magnetizing medium when these discs rotate at an appropriate speed. The main magnets thus have a base inscribed in (or equal to) the base of the pole pieces. Depending on the circumstances, these discs can be driving discs and/or can be mounted loosely on their axis. In order to limit the leakage field in the stack, it is preferable for the internal diameter of the pole pieces to be greater than the internal diameter of the main magnets.

Despite the high coercive field of the magnets in the stack, it is possible for the field available at the surface (or in the air gap) of the magnetizing medium still to be inadequate and to require an increase. In a third variation, the invention also relates to a device which is an improvement to the preceding device, characterized in that the pieces of the stack are, moreover, placed in contact with one or more permanent magnets, known as field magnets, situated at the periphery of the stack, of which the direction of magnetization N-S is parallel to the axis of travel of the strip and in the same direction. Hence, the direction of magnetization of the field magnets is parallel to the plane of the large faces of the stack and perpendicular to the direction of magnetization of the permanent magnets in the stack.

In this case, the pole pieces have a larger cross-sectional area than the main magnets and they enclose them completely. They alone make contact with the field magnets and have a general "comb" shape.

Owing to the field magnets, the main magnets which thus act as anti-leakage magnets, work mainly in the third quadrant of the hysteresis cycle, permitting an increase in the magnetomotive force which they generate and consequently, in the field of the air gap (or in the vicinity of the poles).

As with the single stack, the comb-type system can also be composed of a stack of discs and can be rotational about an axis, but in this case, only the main magnets and the end of the combs situated between the main magnets are movable, the field magnets and the adjacent pole portion remaining stationary and as close as possible to the movable portions.

The field obtained in the air gap can be further increased by inserting between two main magnets adjacent to the same pole piece and by replacing a portion of the said pole piece, an intermediate magnet coupled to these two main magnets and situated alternately in front of and behind the stack in the direction of the axis of travel of the strip, the direction of magnetization N-S of these intermediate magnets being parallel to the axis of travel of the strip and in the opposite direction.

If all the main magnets are of the same thickness (a) and all the pole pieces are of the same thickness (b), except possibly the main end magnets, the value ($p=a+b$) is called the "polar step". However, systems having a variable polar step can also be constructed very simply. The value in maintaining neutral non-magnetized zones is to enclose the field lines at a distance from the sheet, therefore, to be provided with an appreciable force of attraction in the case of work air gaps which are not zero.

The invention will be better understood by means of the drawings which merely show particular non-limiting embodiments, and wherein:

FIGS. 1 and 2 are cross-sections of a strip magnetized in a traversing and non-traversing manner, respectively.

FIGS. 3 and 4 are a section taken along aa' (FIG. 4) and bb' (FIG. 3), respectively, of a traversing magnetization device with a double stack of trapezoidal-shaped elements.

Figure 5:
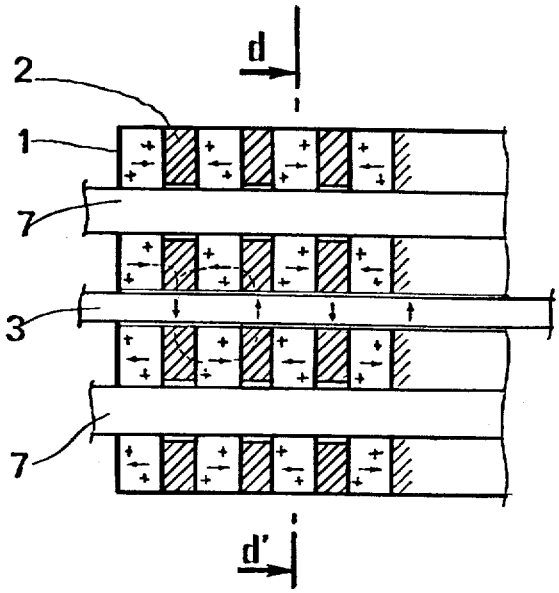
FIGS. 5 and 6 are sectional views along line cc' (FIG. 6) and dd' (FIG. 5), respectively, of a traversing magnetization device with a double stack of circular disc-shaped elements.

A strip of a magnetizable material has traversing magnetization, as shown in FIG. 1, if it has a succession of alternating south poles and north poles separated by neutral zones on the two faces in the width direction. If this arrangement is periodic, the distance between two adjacent poles defines the polar step of magnetization. In this case, the field lines traverse the thickness of the strip and are approximately perpendicular to the faces.

On the other hand, magnetization is non-traversing, as shown in FIG. 2, if there is an alternating succession of north and sourth poles separated by neutral zones over this same width of the strip and on only one of the faces, the field lines closing up on this face and not traversing the thickness of the strip.

The device shown in FIGS. 3 and 4 comprises two stacks on their large faces of flat elements which are alternately permanent magnets 1 made, for example, of a cobalt-rare earth alloy with a high coercive field and ferromagnetic pole pieces 2 made, for example, of an iron-cobalt alloy containing 35% of cobalt. The large faces of these flat elements have a profile which is trapezoidal in the vicinity of the strip 3, as shown in FIG. 4, the small dimension base 4 of the trapezium facing the strip 3. Each of the stacks is held by supports 5 made of soft iron or of any other magnetically mild material. Two magnets 1 situated on either side of the same pole piece 2 have directions of overall magnetization which are preferably perpendicular to the plane of the large faces of the stack and in opposing directions. The strip 3 travels in a plane approximately perpendicular to the large faces of the stack and in a direction (or axis of travel) approximately parallel to the small dimension bases 4 of the flat trapezoidal elements. The two stacks define an air gap 6. Each main magnet 1 and each pole piece 2 of one of the stacks is situated opposite a magnet and a pole piece of the other similar stack, respectively. Moreover, in the case of two facing magnets on either side of the air gap 6, the directions of magnetization oppose each other. This, therefore, produces in the air gap at right angles to the pole pieces, a succession of field lines in alternating directions, represented by the arrows which will imprint an alternating succession of north and south poles separated by neutral zones over the width of the strip 3 traveling in the air gap 6.

To obtain non-traversing magnetization, it is sufficient to use only half of the magnetizing medium, that is to say, a single stack, the other half either being eliminated or replaced by a block of soft iron or other magnetically mild material or by a non-magnetic device permitting, for example, the displacement and guidance of the sheet or the strip.

Figure 6:
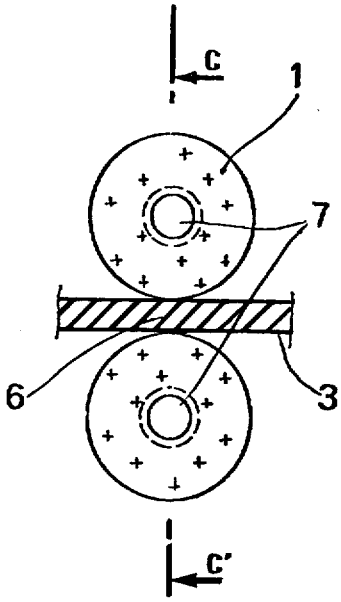

In the variation shown in FIGS. 5 and 6, the stacks are formed by flat elements, main magnets 1 and pole pieces 2 in the form of circular discs which are movable about an axis 7 and have a single right cylindrical lateral surface and rotate at such a speed that the strip is prevented from sliding relative to the magnetizing medium.

Figure 7:
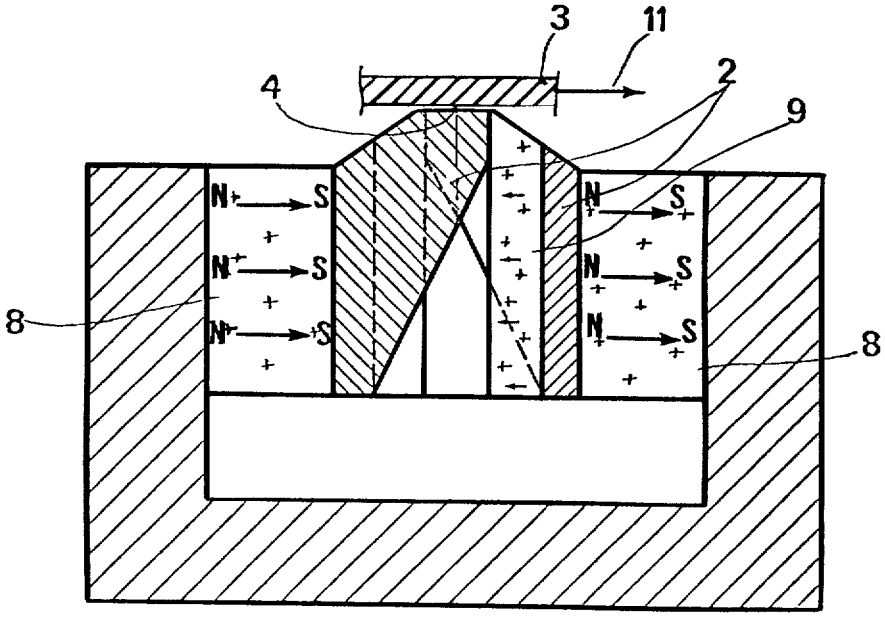
FIG. 7 is a side view and partial sectional along line cc' (FIG. 9) of a non-traversing comb-type magnetization device.
Figure 8:
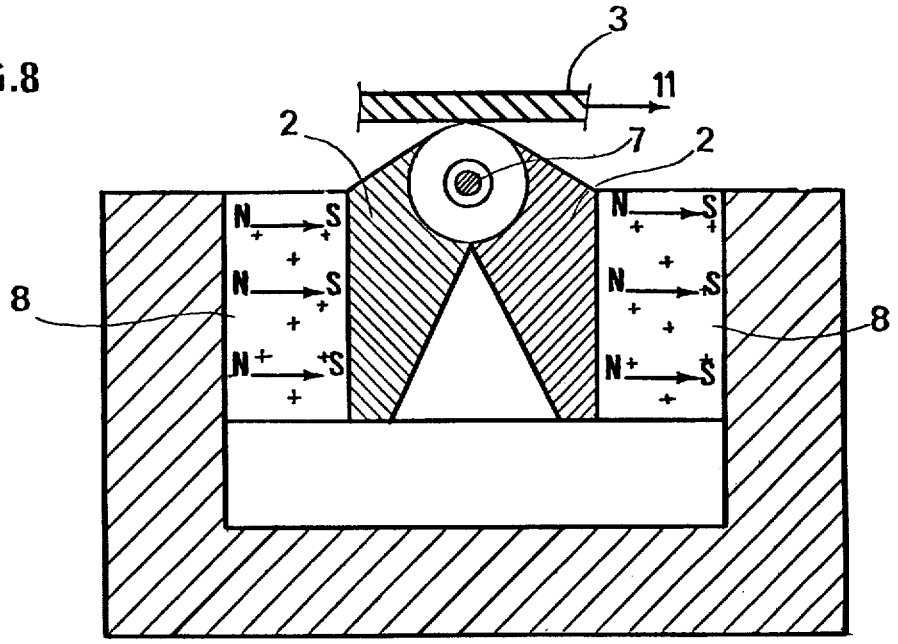
FIG. 8 is a sectional view of the lower portion of a comb-type device for traversing magnetization comprising a movable stack in the vicinity of the strip in a sectional view.
Figure 9:
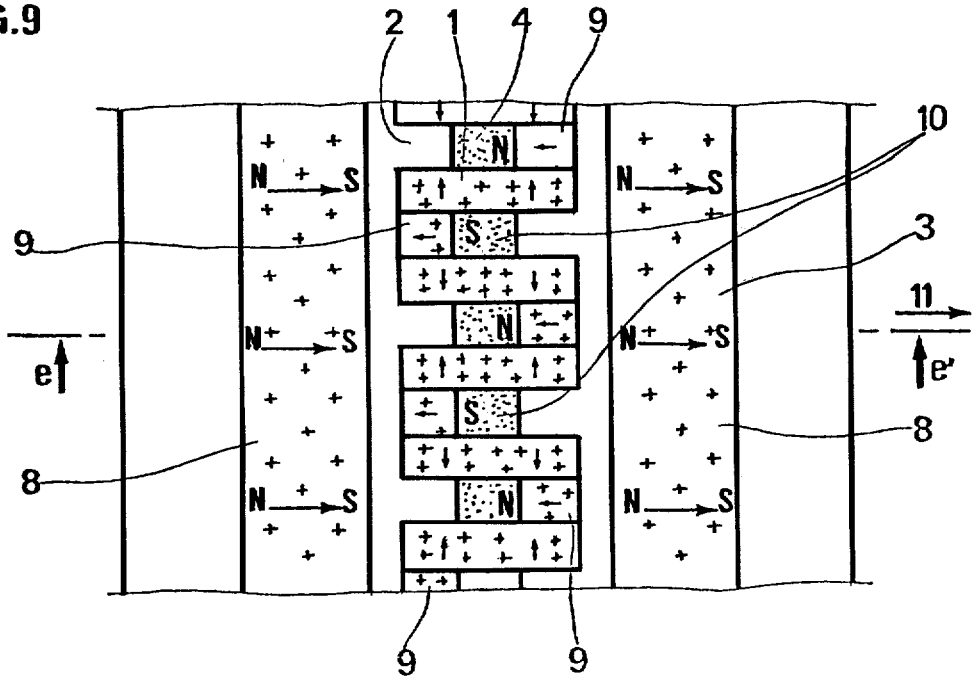
FIG. 9 is a plan view of the apparatus shown in FIG. 7.

In the comb-type device shown in FIGS. 7, 8 and 9, there is a stack of main magnets 1 and of trapezoidal-shaped pole pieces 2 in the vicinity of the strip 3, the small dimension base 4 of the trapezium facing the strip.

The pole pieces 2 have a larger cross-sectional area than the magnets 1 and extend beyond the stacks completely surrounding the magnets 1 and forming a type of comb. These pole pieces 2 are in contact with field magnets 8 which impart to them a certain magnetic potential.

The direction of magnetization of these field magnets 8 is parallel to the axis of travel 11 of the strip 3, that is to say also parallel to the large faces of the stack and to the plane of the strip and, therefore, perpendicular to the directions of magnetization of the magnets 1, as shown in FIG. 9.

The presence of field magnets 8 permits an increase in the magnetomotive force generated by the magnets 1 and, therefore, in the field of the air gap. In addition, the flux created by the field magnets 8 is obliged to pass through the strip 3 due to the presence of main magnets 1.

The active portion of this comb system can exhibit the form of a stack of circular discs rotating about an axis, but the field magnets 8 and the adjacent polar portion remain stationary, as shown diagrammatically in FIG. 8.

In order to further reduce the leakages between the two combs, a portion of the pole piece situated between two main magnets 1 is replaced by an intermediate magnet 9. This intermediate magnet has the shape of a bar perpendicular to the plane of the strip 3 coupled to the two main magnets 1 and situated in front of and behind the stacks alternately relative to the axis of the strip. An S-shaped succession of main magnets 1 and intermediate magnets 9 is thus obtained, as shown in FIG. 9, the latter being arranged in a zig-zag fashion at the ends of the adjacent magnets 1.

The direction of magnetization of these intermediate magnets 9 is parallel to that of the field magnets 8, but in the opposite direction or, alternatively, parallel and in the opposite direction to the axis of travel 11 of the strip 3. A concentration of magnetic flux is thus obtained in the portions of the pole pieces situated in the center of the stack, this flux being directed through the pole pieces toward the small dimension base 4 of the trapezoidal contour in the vicinity of the strip.

In a plane parallel to the plane of the strip, there is a concentration of north and south poles in the zones 1 alternately at the center of the pole pieces of the stack.

To obtain traversing magnetization, a magnetizing medium comprising two similar stacks located one opposite the other and defining an air gap in which the strip 3 travels is used. Here again, the main magnets 1 of each of the stacks face each other as well as the pole pieces, and the directions of magnetization of two facing magnets on either side of the air gap are not parallel to the faces and their resultants are in opposing directions. To obtain non-traversing magnetization, only half of the magnetizing medium is used, the other half being eliminated or replaced by a roll of soft iron or by a non-magnetic device permitting the displacement and guidance of the sheet or of the strip.

The results obtained using the process and the device according to the invention are illustrated by the following examples.

EXAMPLE 1

A stack of stationary magnets made of some 2.5 mm thick $SmCo_5$ alloy and pole pieces made of some 2 mm thick Fe-Co alloy is produced. An induction of 0.4 Tesla (4000 Gauss) in non-traversing magnetization and of 0.65 Tesla (6500 Gauss) in traversing magnetization are obtained in a 3 mm thick air gap in the case of a 3 mm thick flexible strip.

EXAMPLE 2

A stack of some 20 mm diameter discs which are movable about an axis is produced, these discs being alternately 1.3 mm thick, $SmCo_5$ magnets and 1.2 mm thick pole pieces made of Fe-Co alloy. A device of this type permits a magnetic rubber band containing barium ferrite and having a thickness lower than or equal to 1 mm to be magnetized with traversing or non-traversing magnetization to saturation.

The value of the field in the air gap (in air) is 380 kA/m for a distance of 4 mm and attains 1000 kA/m for a distance of 0.8 mm.

EXAMPLE 3

Figure 10:
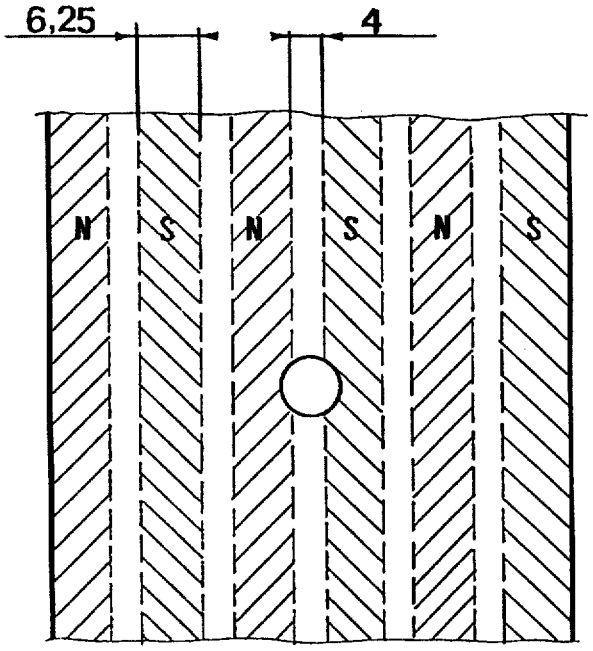
FIG. 10 is a plan view of a magnatizable material magnatized according to the invention with dimensions of the poles and neutral zones shown in millimeters.

A magnetizing medium is constituted by two cylinders comprising "CORAMAG", a trademark of company Aimants Ugimag, (structure $SmCo_5$) having a thickness of 4 mm and pole pieces made of 6.25 mm thick mild steel (that is, a polar step of 10.25 mm). The device was used to magnetize a strip of "FERRIFLEX 3" (also a trademark of Ugimag) having a width of 55.0 mm and a thickness of 2 mm, in the configuration shown in FIG. 10 at a speed of 30 m/mn, which, moreover, is characteristic only of the strip drive system, the magnetizing device not constituting a limit.

The force of attraction measured on a magnetic contact key placed in a hole in this strip, as a function of the distance of the head thereof from the magnetized strip is:

1.2 N at zero distance
0.75 N at a distance of 1 mm
0.35 N at a distance of 2 mm which is at least equal to the values obtained on a strip of the same thickness magnetized on an electromagnetic device whose polar step was 11.5 mm, but at a considerably lower speed of travel (V=1 m/mn), limited by the recharging of the bank of capacitors and the stresses to which the electromagnetic saturator is subjected.

EXAMPLE 4

A comb-type system with intermediate magnets having the same characteristics as the single stack system in Example 1 is produced.

The field in the air gap is then increased by 10%.

In all the preceding examples, it is possible to magnetize in a "traversing" manner, a strip constituted essentially by Ba, Sr and/or Pb ferrite over a thickness close to that of the height of the pole pieces (b) if their diameter is much greater than their height.

We claim:

1. An apparatus for the multipolar magnetization of a hard magnetic material in the the form of a strip or sheet comprising two opposing stacks separated from each other by an air gap wherein the magnetizable material is moved laterally between the stacks, each stack being formed from main permanent magnets having parallel bases and a high coercive field and pole pieces formed of mild magnetic material, said pole pieces being positioned alternately between said permanent magnets, said magnets and pole pieces of each of said stacks being situated in opposing relationship, and the direction of magnetization of said main permanent magnets define opposing components of magnetization perpendicular to said bases of the facing main magnets and said strip.

2. An apparatus according to claim 1, wherein the main magnets are made of an alloy of the cobalt-rare earth type.

3. An apparatus according to either of claims 1 or 2, wherein the pole pieces are made of soft iron or of an iron-cobalt alloy.

4. An apparatus according to claim 1, wherein the flat stacked elements have a lateral surface area which diminishes in the vicinity of the air gap.

5. An apparatus according to claim 4, wherein the base of the flat element is trapezoidal, the small base of the trapezium being in the vicinity of the air gap.

6. An apparatus according to claim 4, wherein the base of the flat elements is circular and the flat elements are movable about their axis.

7. An apparatus according to claim 6, wherein the flat elements have the same cylindrical lateral surface area.

8. An apparatus according to claim 6, wherein the internal diameter of the pole pieces is greater than that of the internal diameter of the main magnets.

9. An apparatus according to claim 1, wherein the pole pieces are connected by means of a magnetically mild material with at least one permanent field magnet situated on the periphery of the stack of which the direction of magnetization has a component in the same direction as the axis of travel of the sheet or strip.

10. An apparatus according to claim 9, wherein the stacks are movable about an axis.

11. An apparatus according to claim 10, wherein one portion of each stationary pole piece comprises an intermediate magnet coupled to two main magnets, the latter being placed alternately in front of and behind the stack in the direction of travel of the strip, the direction of magnetization of these intermediate magnets having a component of direction opposed to the axis of travel of the strip.

12. A process for the multipolar magnetization of a hard magnetizable material in the form of a strip or sheet consisting of:

(a) establishing a controllable external magnetic flux in a device having at least one magnetic stack, which stack is formed of permanent magnets and alternating pole pieces of magnetically mild material, each of said permanent magnets in said stack having a trapezoidal cross-section and a base comprising one of the parallel sides of said trapezoid defining a component of magnetization perpendicular to said base of said magnets and in a direction opposite to said permanent magnets adjacent said pole pieces, (b) moving said magnetizable material adjacent said base of said magnetic stack such that said pole pieces orientates and concentrates said magnetic flux along the width of said material, and (c) magnetizing said magnetizable material to impart non-traversing magnetization thereto.

13. A process for the multipolar magnetization of a hard magnetizable material in the form of a strip or sheet consisting of:

(a) establishing a controllable external magnetic flux in a device utilizing at least two opposed stacks of permanent magnets and alternating pole pieces of magnetically mild material, each of said permanent magnets having a trapezoidal cross-section and a base comprising one of the parallel sides of said trapezoid, (b) establishing at least one component of magnetization perpendicular to said base and in a direction opposite to said permanent magnets adjacent said pole piece, (c) moving said magnetizable material past the lateral surfaces of said magnetic stacks such that said bases of said magnets orients and concentrates said magnetic flux along the width of said material, (d) directing magnetic flux to said magnetizable material such that the direction of magnetization of said main permanent magnets define opposing components of magnetization perpendicular to said bases of the facing main magnets, and (e) magnetizing said strip or sheet to impart traversing magnetization thereto.

* * * * *